US005997014A

United States Patent [19]

Ellis et al.

[11] Patent Number: 5,997,014

[45] **Date of Patent: *Dec. 7, 1999**

[54] BRAKING SYSTEM FOR AN IN-LINE SKATE

[75] Inventors: Todd D. Ellis, Boston; David J. Lacorazza, Norwell, both of Mass.; Daniel A. Nolan, Salem; Lennart B. Johnson, Milford, both of N.H.

[73] Assignees: Reebok International Ltd., Stoughton, Mass.; V2 Jenex, Inc., Milford, N.H.

[ * ] Notice: This patent is subject to a terminal disclaimer.

[21] Appl. No.: 08/932,372

[22] Filed: Sep. 17, 1997

Related U.S. Application Data

[63] Continuation-in-part of application No. 08/733,813, Oct. 18, 1996, Pat. No. 5,755,450.

[51] Int. Cl.[6] ..... A63C 17/14; B60T 1/14

[52] U.S. Cl. ..... 280/11.2; 280/11.22; 188/5; 188/82.84

[58] Field of Search ..... 280/11.2, 11.22; 188/5, 82.77, 82.84

[56] References Cited

U.S. PATENT DOCUMENTS

| | | | |
|---|---|---|---|
| 920,848 | 5/1909 | Eubank, Jr. . | |
| 979,169 | 12/1910 | Kennedy . | |
| 1,402,010 | 1/1922 | Ormiston . | |
| 3,224,785 | 12/1965 | Stevenson . | |
| 4,088,334 | 5/1978 | Johnson . | |
| 4,275,895 | 6/1981 | Edwards . | |
| 4,298,209 | 11/1981 | Peters . | |
| 4,526,389 | 7/1985 | Chase . | |
| 4,817,974 | 4/1989 | Bergeron | 280/11.2 |
| 5,088,748 | 2/1992 | Koselka et al. . | |
| 5,118,122 | 6/1992 | Ricart . | |
| 5,183,275 | 2/1993 | Hoskin | 280/11.2 |
| 5,374,070 | 12/1994 | Pellegrini, Jr. et al. . | |
| 5,374,071 | 12/1994 | Johnson . | |
| 5,388,844 | 2/1995 | Pellegrini, Jr. et al. . | |
| 5,397,137 | 3/1995 | Pellegrini, Jr. et al. . | |
| 5,411,276 | 5/1995 | Moldenhauer . | |
| 5,415,419 | 5/1995 | Bourque . | |
| 5,435,579 | 7/1995 | Pozzobon . | |
| 5,435,580 | 7/1995 | Balbinot et al. . | |
| 5,439,238 | 8/1995 | Neal . | |
| 5,462,296 | 10/1995 | Pozzobon . | |
| 5,465,984 | 11/1995 | Pellegrini, Jr. et al. . | |
| 5,470,085 | 11/1995 | Miebock et al. . | |
| 5,478,094 | 12/1995 | Pennestri | 280/11.2 |
| 5,484,164 | 1/1996 | McInerney et al. . | |
| 5,486,011 | 1/1996 | Nelson . | |
| 5,486,012 | 1/1996 | Olivieri . | |
| 5,487,552 | 1/1996 | Daoust . | |
| 5,505,468 | 4/1996 | Pozzobon et al. . | |

(List continued on next page.)

FOREIGN PATENT DOCUMENTS 585764 3/1994 Italy .

OTHER PUBLICATIONS

Strong, Ph.D., "Versatility in Pultrusion," *Composites Fabrication*, Jun. 1996, pp. 9–13.

*Primary Examiner*—Lanna Mai
*Assistant Examiner*—Bridget Avery
*Attorney, Agent, or Firm*—Sterne, Kessler, Goldstein & Fox P.L.L.C.

[57] ABSTRACT

A braking system for an in-line skate. The skate includes a boot mounted on a chassis. A cuff is rotatably mounted on the chassis. The chassis also has a plurality of wheels rotatably mounted thereon. The braking system for the skate includes a brake pad housing which is either fixedly or pivotally attached to a rear portion of the cuff, a brake pad disposed in the housing, and a roller arm rotatably mounted on the chassis. The roller arm is spring loaded so that when the brake is not in use, the roller arm is disposed above the wheels. The roller arm has a bearing assembly disposed therein, so that when the brake is actuated by a rearward rotation of the cuff, the brake pad engages the bearing assembly of the roller arm, thereby causing said bearing assembly to engage at least one of the wheels to slow and/or stop the skate. A rear wheel of the skate may be biased to enhance the braking action and reduce wheel wear.

23 Claims, 9 Drawing Sheets

U.S. PATENT DOCUMENTS 5,505,469 4/1996 Zorzi et al. .
5,511,803 4/1996 Klukos ..... 280/11.2
5,511,804 4/1996 Pellegrini, Jr. et al. .
5,527,048 6/1996 Conte ..... 280/11.2
5,575,489 11/1996 Oyen et al. .
5,588,734 12/1996 Talamo et al. .
5,590,889 1/1997 Pozzobon .
5,630,597 5/1997 Klukos ..... 280/11.2
5,639,104 6/1997 Haldermann .
5,649,715 7/1997 Mitchell .
5,651,556 7/1997 Mitchell .
5,664,794 9/1997 Mitchell et al. .
5,755,449 5/1998 Pozzobon ..... 280/11.2
5,755,450 5/1998 Ellis et al. ..... 280/11.2
5,769,433 6/1998 Zorzi et al. ..... 280/11.2
5,791,663 8/1998 Klukos ..... 280/11.2
5,860,492 1/1999 Talaska ..... 188/5

102
104
201
122
218
124
202
204
206
212
212
118
118
126
220
208
216
208
214
208
210
222
208
224
226
106
109
215
215
105
108
213
213
211
211

BRAKING SYSTEM FOR AN IN-LINE SKATE

CROSS-REFERENCE TO RELATED APPLICATION

The present application is a continuation-in-part of U.S. patent application Ser. No. 08/733,813 to Ellis et al., filed Oct. 18, 1996, now U.S. Pat. No. 5,755,450.

BACKGROUND OF THE INVENTION

1. Field of the Invention

The present invention relates to a braking system for an in-line skate. In particular, the present invention relates to a cuff-activated brake pad and roller arm assembly for braking a wheel of an in-line skate.

2. Related Art

Many different types of skate brakes have been developed for in-line skates to address the problem of stopping or slowing while skating. The materials used to make conventional skate wheels and bearings have advanced considerably in the past few years. These advancements allow a skater to travel very quickly, up to at least speeds of 15 to 20 mph, using conventional skates.

As the popularity of in-line skating grows, especially in urban areas, the numbers of skaters on streets and paths increase. With this increase in the number of skaters, there is an increased risk of the chance of collisions between skaters and other skaters, bikers, joggers, pedestrians or cars. Thus, there is a need for a skate brake which will allow skaters to slow and/or stop themselves quickly and retain maneuverability while braking to avoid or prevent an accident A conventional skate brake consists of a large piece of a rubber brake pad, typically attached to the rear of the skate chassis on at least one skate (left or right) in a pair of skates. In operation, the skater must lift the toe of the skate to which the brake is attached, until the rubber brake pad touches and grabs the skating surface to slow the skater. This conventional skate brake has several drawbacks.

A conventional skate brake is awkward to use, because the skater must pick up the toe of one of the skates and at the same time exert a downward force on the brake pad to slow the skate. It is difficult for a beginner and even an intermediate in-line skater to effectuate braking using this conventional brake while maintaining his balance. The result is that in order to compensate for the awkwardness of the braking position, the skater may not exert as much of a downward force on the brake pad. Thus, it takes a long time to slow the skate or bring the skate to a complete stop. This problem is exacerbated when trying to slow or stop while traveling downhill.

Further, a skater is apt to lose his balance by trying to brake while skating over a bumpy surface, because the skater must lift the toe of the skate to force the brake toward the ground. Thus, one foot of the skater is traveling on only one wheel of the skate, the remaining skate wheels being raised off the ground during braking. Having only one wheel in contact with the ground makes the skate difficult to maneuver particularly on a bumpy or uneven skating surface. Further, the contact between the brake pad and the ground during braking makes it difficult to turn the skate. Thus, during braking using a ground-engaging brake, the skater loses control over maneuverability of the skate, thereby increasing the likelihood of a collision.

Another drawback of the conventional skate brake is that a conventional rubber brake pad is relatively soft compared to most skating surfaces, and thus must be replaced frequently due to excessive wear of the pad from braking.

Another drawback of the conventional skate brake is that it is often difficult for the skater to stop the skate when traveling on a rough or bumpy skating surface, because there is less braking surface for the brake pad to grab to slow the skate. Further, vibrations from the bumpy skating surface will cause the skate to bounce so that the brake pad loses contact momentarily with the ground. These factors result in less effective braking and a slower response for slowing or stopping the skate using a conventional brake.

Still another drawback of the conventional skate brake is that the amount of downward force exerted by the skater on the brake pad is limited by the skater's body weight, fitness level and the awkwardness of the position that must be maintained to brake. As such, it is difficult for a skater using a conventional skate brake to stop or slow the skate in a short distance. The above-referenced drawbacks of the conventional skate brake result in reaction times of the skater to potential hazards being slowed significantly.

A second type of skate brake is a cuff-activated brake having a rotatable cuff that forces a rubber brake pad against the skating surface. To actuate the brake, the skater moves his foot forward of his other foot. As the skater's foot moves forward, the skater's calf forces the cuff to rotate rearwardly with respect to the skate boot. A rod or other mechanism attached to the cuff is thereby forced toward the ground. A brake pad, disposed on the lower end of the rod, is forced against the ground.

Activation of this type of cuff-activated brake is not as awkward as a conventional brake, because the skater does not have to lift any wheels of the skate off the ground to actuate the brake. Because this type of braking system allows the skater to better maintain his balance while braking, the skater can often exert more of a downward force on the brake pad, thereby slowing or stopping the skate faster than with a conventional brake. However, the use of a rubber brake pad to engage the ground includes the same drawbacks as discussed above. Namely, the use of a ground-engaging brake pad makes it difficult to brake on bumpy or rough skating surfaces, the skater loses control over maneuverability of the skate during braking, and the rubber brake pad requires frequent replacement due to wear.

Other skates have braking systems that combine a conventional skate brake with a mechanism for simultaneously applying a braking force to one or more of the wheels of the skate. Thus, when the skater tilts the skate to engage the brake pad with the skating surface, the downward force on the brake pad simultaneously activates a second braking mechanism which applies a braking force directly against at least one wheel of the skate. Although this type of braking system applies a second brake directly against the wheel of the skate, the rubber brake pad that contacts the skating surface results in loss of control over maneuverability of the skate. Further, it is difficult to brake on rough or bumpy skating surfaces. Also, the skater must place his body in an awkward position to activate the brake, thereby throwing him off balance and limiting the overall effectiveness of the brake.

Thus, what is needed is a braking system that will effectively apply a sufficient force to a braking member to stop or slow a skate traveling at high speeds in a short distance. Further, what is needed is a braking system that does not require the skater to upset his/her balance and/or center of gravity to actuate the brake. Further, a braking system is needed that provides the skater with controlled maneuverability of the skate while braking.

SUMMARY OF THE INVENTION

The cuff-activated braking system of the present invention provides a braking system that overcomes many of the drawbacks of conventional skate brakes. A skater using the braking system of the present invention can easily actuate the brake to slow or stop the skate quickly and effectively, while maintaining controlled maneuverability of the skate. Thus, response time for the skater is significantly improved, because the skater has more control over the speed of the skates during use, and the skater may also easily avoid potential hazards while braking by maneuvering the skate to avoid a collision.

The skate of the present invention includes a skate boot attached to a chassis. The chassis has a plurality of wheels disposed on its lower surface. The braking system of the present invention includes a cuff-activated braking assembly, and a roller arm assembly. The braking assembly is attached to the cuff of the skate and includes a brake pad disposed within a housing. The brake pad is vertically adjustable in the housing to adjust the sensitivity of the braking system.

The roller arm assembly is pivotally spring-mounted to the chassis and includes a roller arm and a bearing assembly. The spring of the roller arm assembly maintains the roller arm in an uppermost position relative to the chassis during normal skating. When the skater wishes to slow or stop the skate, he rotates the pivotally-mounted cuff portion rearwardly, so that the cuff forces the braking assembly in a downward direction.

The brake pad of the braking assembly engages the bearing assembly of the roller arm and forces it downwardly toward the rear wheel of the skate. Thus, the brake pad frictionally engages and slows rotation of the bearing assembly, which, in turn, engages and slows the rear wheel, thereby slowing the skate. Because there is virtually no sliding between the wheel and bearing assembly, there is no appreciable wheel wear due to contact between the bearing assembly and wheel.

In another aspect of the invention, the brake pad housing is pivotally mounted on the cuff, and the braking assembly further includes a linkage member. The linkage member is pivotally attached on one end to the chassis and is pivotally attached on the other end to the brake pad housing. This configuration accommodates braking for different sizes of skate wheels by isolating the rotation of the housing from the rotation of the cuff. Thus, the brake pad is accurately positioned for fill engagement with the bearing assembly during braking.

In another aspect of the invention, braking performance can be further enhanced by biasing the rear wheel toward the ground when the brake is actuated, thereby maintaining constant contact between the braked wheel and the ground. The brake system generally includes a brake adjustment mechanism, a brake pad arm, a roller arm and a biased rear wheel. The brake adjustment mechanism enables the skater to adjust the sensitivity of the brake by increasing or decreasing the amount of cuff rotation required to actuate the brake.

When the skater rotates the cuff rearward, a contact point on the lowermost portion of the cuff contacts the brake pad arm which rotates downward to contact the roller disposed in the roller arm. The roller then contacts the biased rear wheel. The biased rear wheel is mounted in a biased frame portion that allows the biased rear wheel to rotate downward during the braking motion. Hence, the biased rear wheel maintains constant contact with the ground during braking which, in conjunction with the frictional engagement of the braking system members, causes a slowing of the rotation of the biased rear wheel, thereby stopping the skate more effectively and with less wheel wear.

BRIEF DESCRIPTION OF THE FIGURES

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

A preferred embodiment of the present invention is now described with reference to the figures where like reference numbers indicate identical or functionally similar elements. Also in the figures, the left most digit of each reference number corresponds to the figure in which the reference number is first used. Further, although only one skate in a pair of skates is shown in the figures, the left and right skates are mirror images of each other, except that typically only one of the two skates has a brake attached thereto. While specific configurations and arrangements are discussed, it should be understood that this is done for illustrative purposes only. A person skilled in the relevant art will recognize that other configurations and arrangements can be used without departing from the spirit and scope of the invention.

Figure 1:
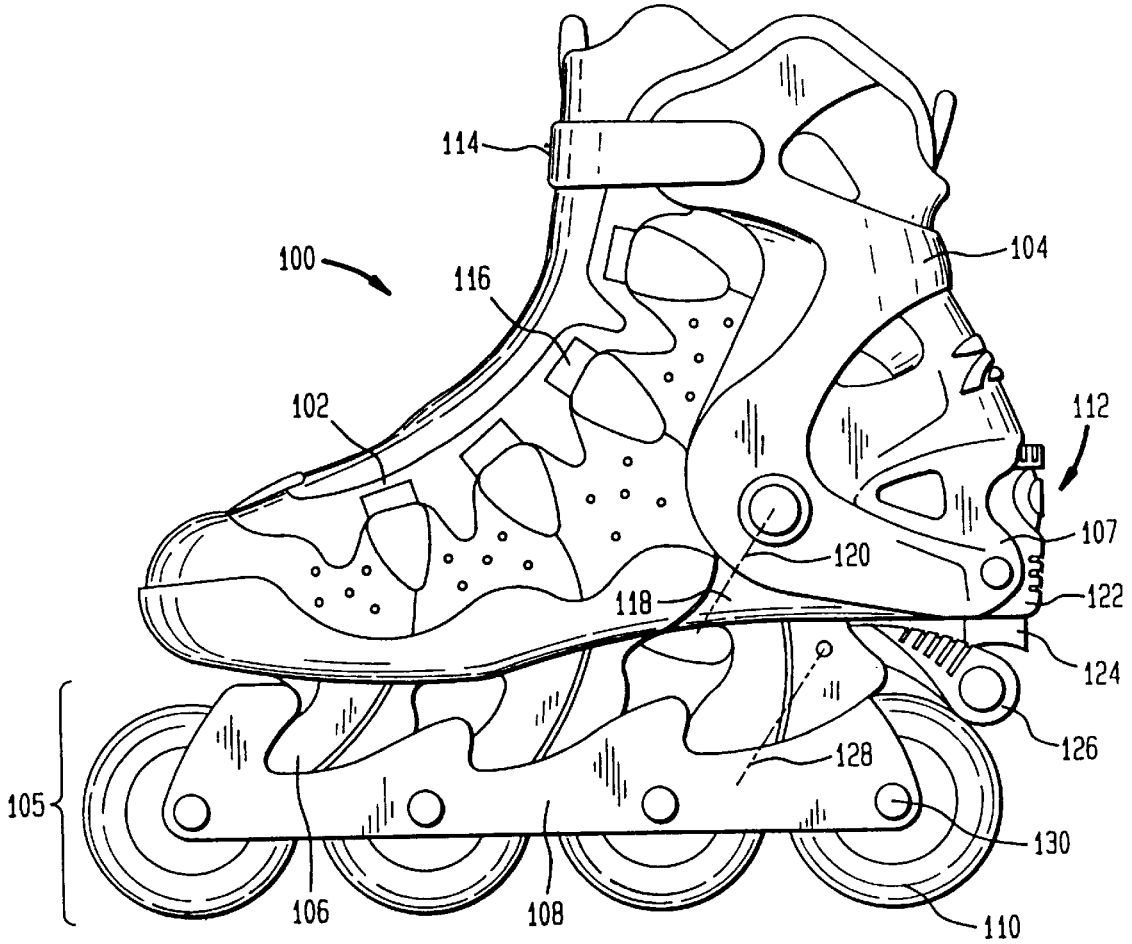
FIG. 1 shows a side view of a skate with a braking system of the present invention.

FIG. 1 shows a skate 100 having a boot 102 and a cuff 104. Boot 102 may be made from a soft material, such as nylon or leather, or may be injection molded from a plastic material or made using other processes apparent to one skilled in the relevant art. Cuff 104 can be injection molded from a plastic material or thermoformed from a composite. Skate 100 also includes a chassis 105, consisting of a transition mount 106 and a frame member 108. In one embodiment, frame member 108 is made by pultrusion. In one embodiment, frame member 108 is made from extruded aluminum. However, it would be apparent to one skilled in the relevant art that frame member 108 could also be made by injection molding, die casting, machining or other known manufacturing techniques.

Pultrusion is a process for making composite parts having a nearly constant cross-section on a continuous basis. In the pultrusion process, fibers, including fiber mats or cloths, are joined to form a fiber bundle which is soaked in a resin bath until it is completely wetted. Excess resin is then removed from the wetted fiber bundle, and the bundle is directed into a heated die. The part is then shaped and cured in the die. The die interior dimensions gradually reduce in size until the final shape is achieved. During this shaping, the part is cured by either thermally heating the die or by subjecting the material to radio frequency (rf) radiation. A puller system, either a series of part-shaped grippers or double continuous belts or caterpillar pullers, pull the part through the die. Part cut-off and packaging is completed after the puller. This process is described in further detail in an article by A. Brent Strong, Ph.D., entitled "Versatility in Pultrusion," *Composites Fabrication*, June, 1996, pp. 9–13, the disclosure of which is incorporated herein by reference.

Transition mount 106 has a channel 209 to receive frame member 108. Thus, transition mount 106 is used to accommodate pultruded frame member 108 and to provide a raised footbed for the skater. In one embodiment, transition mount 106 is made by injection-molding. However, it would be apparent to one skilled in the relevant art that transition mount 106 could also be made by extrusion, die casting, machining or other known manufacturing techniques. Boot 102 may be rigidly attached to transition mount 106 by gluing, screwing or by other fastening means apparent to one skilled in the relevant art.

Figure 5:
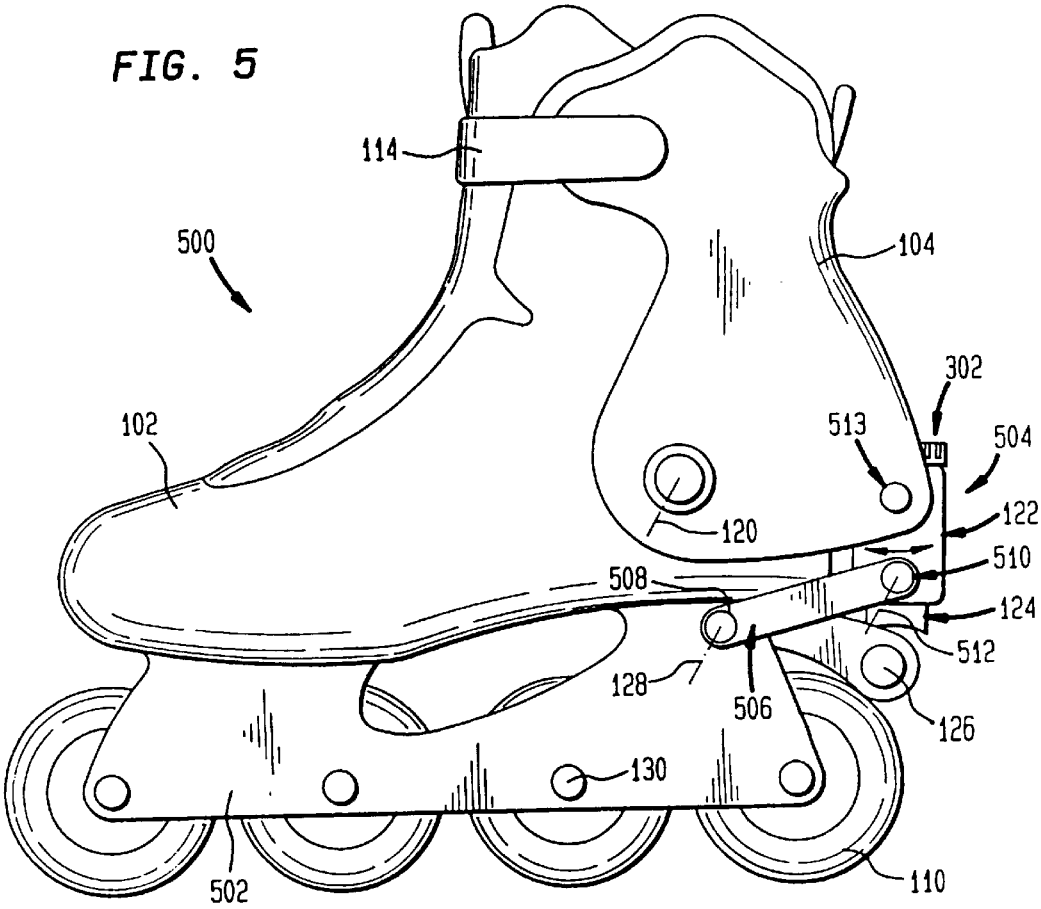
FIG. 5 shows an second embodiment of a braking system of the present invention.

In another embodiment, frame member 108 and transition mount 106 could be injection molded from a single piece of material to form a unitary chassis 502, as shown in FIG. 5. Similarly, it would be apparent to one of skill in the relevant art, to mold boot 102 and chassis 105 as a unitary member.

Frame member 108 has a plurality of wheels 110 rotatably mounted thereon. Although wheels 110 are shown in FIG. 1 as being aligned, it would be apparent to one skilled in the relevant art that other wheel configurations could also be used. Wheels 110 are rotatably mounted on axles 130 which are mounted on frame member 108. Wheels 110 may be conventional and include a bearing and spacer arrangement (not shown).

Skate 100 further includes a cuff strap 114 which is used to securely attach the upper portion of boot 102 and cuff 104 around the wearer's ankle. Boot 102 also has loops 116 for inserting a lace (not shown) therein. However, boot 102 could also use a series of buckles to secure the boot to the wearer's foot, or use any other closure system apparent to one skilled in the relevant art.

Transition mount 106 has flanges 118 extending upwardly from the medial and lateral sides thereof. Cuff 104 is rotatably mounted on flanges 118 of transition mount 106. Cuff 104 rotates about rotary axis 120. A braking system 112 consisting of a braking assembly 300 and a roller arm assembly 400 (described in further detail with respect to FIGS. 3 and 4, respectively) is disposed on the rear of skate 100. In particular, braking assembly 300 is mounted on flanges 107 of cuff 104. Braking system 112 includes housing 122 with a brake pad 124 disposed therein and a roller arm 126 rotatably mounted on transition mount 106. Roller arm 126 is mounted on transition mount 106 about a rotary axis 128 and can be injection molded from a piece of plastic material, machined or made using other processes which would be apparent to one skilled in the relevant art.

In operation, a skater moves skate 100, having a brake mounted thereon, forwardly with respect to the remaining skate so that the skater's calf causes cuff 104 of skate 100 to rotate rearwardly with respect to boot 102. Rearward rotation of cuff 104 causes housing 122 and brake pad 124 to move downwardly. As brake pad 124 moves downwardly, it engages a bearing assembly 406, thereby forcing roller arm 126 to rotate toward rear wheel 110 of skate 100. Bearing assembly 406 (described in detail with respect to FIG. 4) of roller arm 126 engages rear wheel 110, thereby slowing skate 100.

Figure 2:
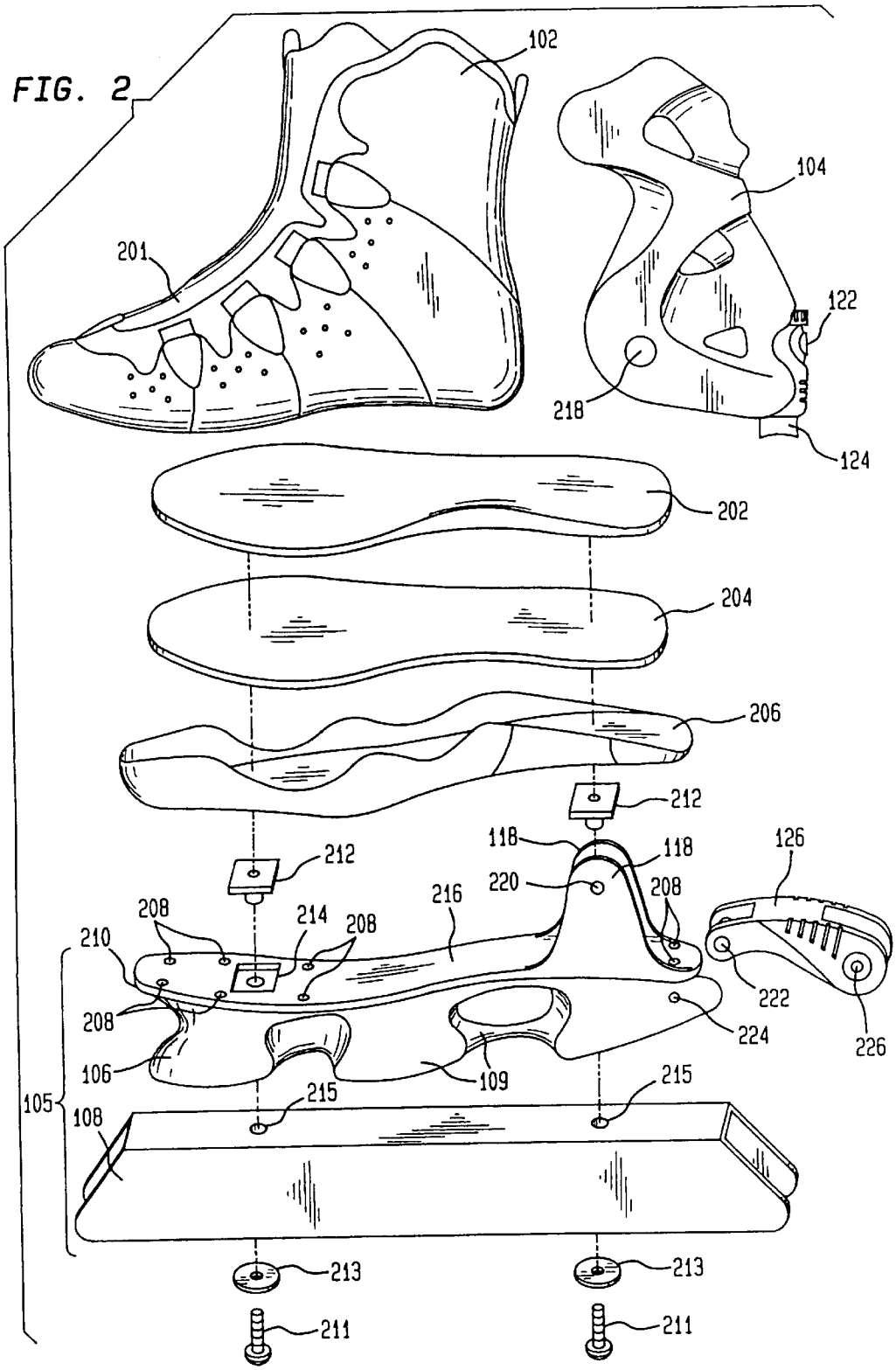
FIG. 2 shows an exploded perspective view of the skate of the present invention.

FIG. 2 shows an exploded view of skate 100 of the present invention. As shown in FIG. 2, boot 102 includes an upper 201, a sockliner 202, a lasting board 204 disposed below sockliner 202 and a rubber outsole 206 disposed below lasting board 204. Upper 201 is attached to transition mount 106 via rivets (not shown) which pass through holes 208 in transition mount 106 from a lower surface 210 thereof and pass through rubber outsole 206 and lasting board 204. The rivets are then peened over to anchor the assembly together. The edges of upper 201 are folded under lasting board 204 and cemented thereto according to conventional shoemaking techniques. The upper surface of rubber outsole 206 is also cemented to upper 201. The lower surface of rubber outsole 206 further includes a recessed cavity (not shown) to receive transition mount 106.

Frame member 108 is mounted to transition mount 106 by two bolts 211 passing through washers 213 and through holes 215 in frame member 108 from the bottom thereof and into two special square nuts 212. Nuts 212 fit within matching square recesses 214 on a top surface 216 of transition mount 106.

Cuff 104 is attached to flanges 118 of transition mount 106. Holes 218 on the medial and lateral sides of cuff 104 are aligned with holes 220 on flanges 118 of transition mount 106. A rivet, screw, or nut and bolt assembly (not shown) can be inserted into aligned holes 218 and 220 to pivotally attach cuff 104 to flanges 118. Similarly, a first set of holes 222 in roller arm 126 are aligned with holes 224 on the medial and lateral sides of transition mount 106. A rivet, screw, or nut and bolt assembly can be inserted through aligned holes 222 and 224 to pivotally attach roller arm 126 to transition mount 106. As shown in FIG. 2, roller arm 126 also has a second set of holes 226 formed therein for mounting a bearing assembly (shown in FIG. 4) therebetween.

Figure 3:
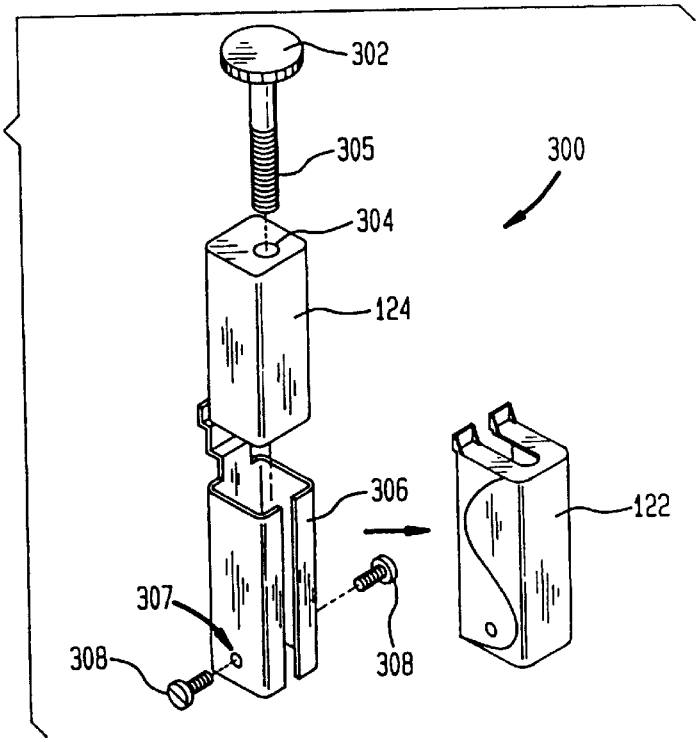
FIG. 3 shows an exploded perspective view of a braking assembly of the present invention.

FIG. 3 shows an exploded view of braking assembly 300 of the present invention. Braking assembly 300 includes an adjuster knob 302, brake pad 124, a bracket 306 and a housing 122. Brake pad 124 is inserted into bracket 306. In one embodiment, bracket 306 is made from stamped steel. Further, brake pad 124 is made from a hard material and has a concave shape at its lower end to engage the bearing assembly of roller arm 126. In one embodiment, brake pad 124 is made from a hard rubber material. Brake pad 124 could also be made from other materials, such as ceramic, plastic, asbestos, or other materials commonly used for brake pad shoes. Brake pad 124 includes a threaded insert 304 disposed in the top of the pad.

Adjuster knob 302 has a threaded end 305 which is screwed into threaded insert 304 of brake pad 124. Adjuster knob 302 may be rotated to adjust the height of brake pad 124 relative to stamped steel bracket 306, thereby adjusting the sensitivity of the braking system. Housing 122 is placed over bracket 306 and screws 308 pass through holes in flanges 107 of cuff 104 and thread into threaded holes 307 in bracket 306, to attach braking assembly 300 to cuff 104. In one embodiment, housing 122 is injection molded.

Figure 4:
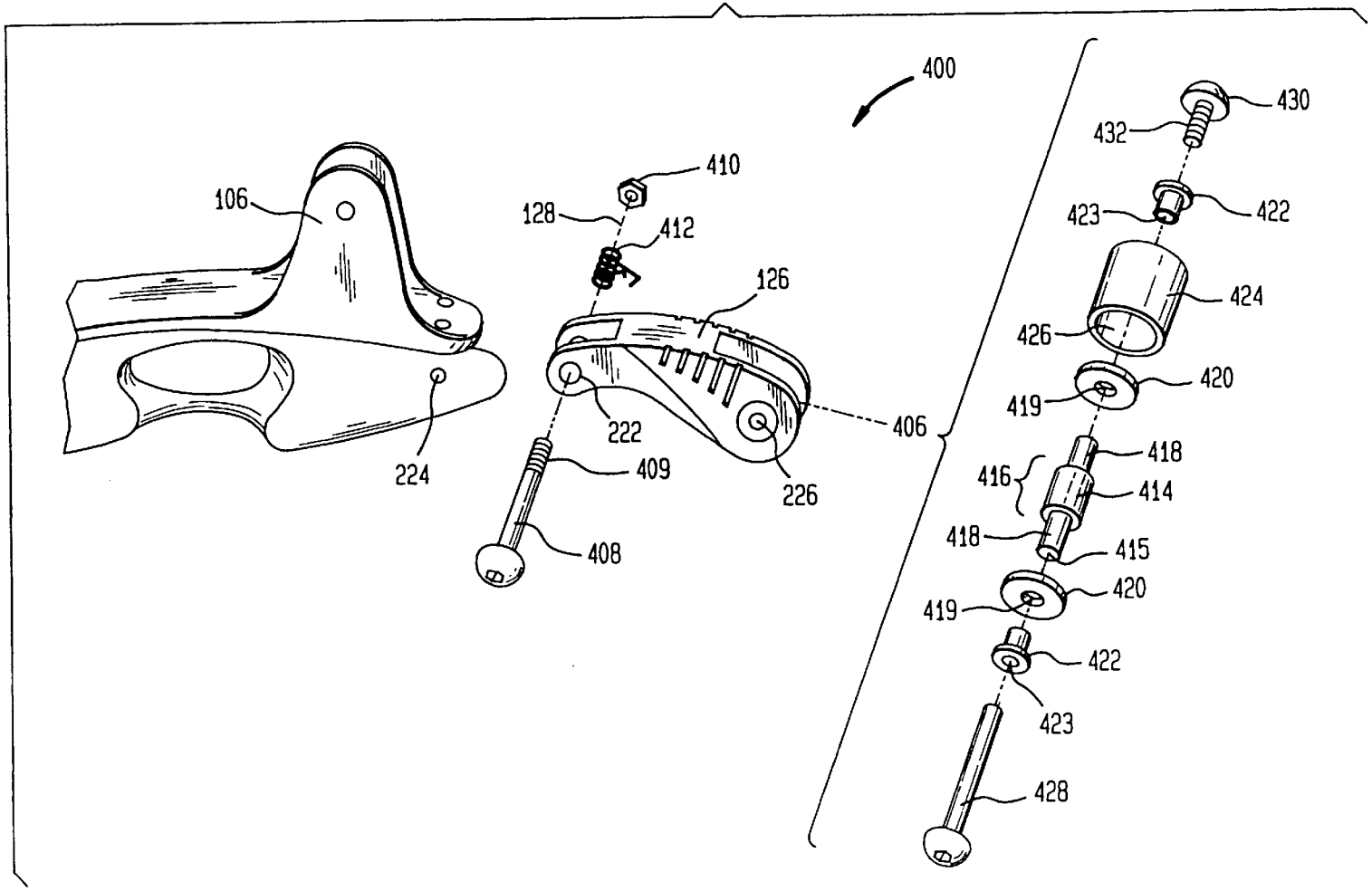
FIG. 4 shows an exploded perspective view of a roller arm assembly of the present invention.

FIG. 4 shows an exploded view of a roller arm assembly 400. Roller arm 126 includes first set of holes 222 and second set of holes 226. First set of holes 222 are used to attach roller arm 126 to transition mount 106. Roller arm 126 is connected to transition mount 106 via an axle 408 and a lock nut 410. Axle 408 is inserted through first set of holes 224 of transition mount 106 and through corresponding holes 222 in roller arm 126. Axle 408 has a threaded end 409, so that lock nut 410 can be screwed on the end of axle 408 to retain axle 408 in roller arm 126. This attachment assembly allows roller arm 126 to be pivotally mounted to transition mount 106 so that it rotates about rotary axis 128.

As shown in FIG. 4, a coil spring 412 is disposed on axle 408 between forked portion of roller arm 126. Coil spring 412 spring loads roller arm 126, so that bearing assembly 406 does not contact rear wheel 110 during normal use of the skate. Thus, only when the skater rotates cuff 104 rearwardly, thereby causing brake pad 124 to overcome the force of coil spring 412, does bearing assembly 406 engage rear wheel 110 of the skate.

A bearing assembly 406 is disposed between second set of holes 226 of roller arm 126. During operation of the braking system, bearing assembly 406 comes into contact with a wheel of the skate to slow the wheel. In the preferred embodiment, bearing assembly 406 engages the rear wheel of the skate.

Bearing assembly 406 includes a spacer 414 having a hole 415 formed therethrough. Spacer 414 is disposed between second set of holes 226 of roller arm 126. Spacer 414 has a cuff portion 416 and two arm portions 418 on either side of cuff portion 416. The diameter of cuff portion 416 is larger than arm portions 418. Two bearings 420, having holes 419 formed therein, are rotatably mounted on arm portions 418 of spacer 414. The diameter of holes 419 is smaller than the diameter of cuff portion 416 so that bearings 420 remain spaced apart by cuff portion 416. Two bushings 422, each having holes 423 formed therein, are inserted into holes 419 of bearings 420 to prevent the sides of bearings 420 from coming into contact with the inner sides of roller arm 126. A sleeve 424 is then slid over bearing assembly 406, so that bearings 420 are disposed within an inner surface 426 of sleeve 424. The fit between bearings 420 and sleeve 424 is such that bearings 420 cannot rotate relative to sleeve 424. In the preferred embodiment, sleeve 424 is made of hardened steel. However, it would be apparent to one skilled in the relevant art that any relatively hard and durable material could be used for sleeve 424.

Bearing assembly 406 is placed between second set of holes 226 of roller arm 126 so that holes 415, 419 and 423 in the components of bearing assembly 406 align with second set of holes 226. Bearing assembly 406 is rotatably mounted between second set of holes 226 via an axle 428 that is inserted through the aligned holes of roller arm 126 and bearing assembly 406. Axle 428 has a threaded inner surface on one end (not shown). A bolt 430, having a threaded end 432, is inserted into the threaded end of axle 428 to prevent axle 428 from disengaging from bearing assembly 406.

In operation, brake pad 124 frictionally engages sleeve 424 of bearing assembly 406. Further, the downward force of brake pad 124 causes roller arm 126 to rotate about rotary axis 128 so that sleeve 424 engages rear wheel 110 of skate 100. As sleeve 424 is pressed between brake pad 124 and wheel 110, brake pad 124 slows rotation of sleeve 424. There is no sliding between sleeve 424 and wheel 110, so that the slowed rotation of sleeve 424, in turn, slows wheel 110. Further, because there is no sliding between sleeve 424 and wheel 110 at their interface, there is virtually no wheel wear due to contact between wheel 110 and sleeve 424.

FIG. 5 shows an alternate embodiment of a skate 500 of the present invention. Skate 500 includes boot 102 and cuff 104, as described with respect to FIG. 1. Skate 500 also includes a chassis 502 which is made from a unitary piece of material, as discussed above.

Skate 500 is assembled as shown in FIG. 2. Chassis 502 has a plurality of wheels 110 rotatably mounted thereon. Wheels 110 are rotatably mounted on axles 130 which are mounted on chassis 502. In one embodiment, chassis 502 is made from injection-molded plastic. However, it would be apparent to one skilled in the relevant art that chassis 502 could also be made by die casting, machining or other known manufacturing techniques.

In this embodiment, cuff 104 is rotatably mounted to rigid supports (not shown) within the lateral and medial sides of boot 102. Cuff 104 rotates about rotary axis 120. A braking system 504 consisting of braking assembly 300 and roller arm assembly 400 is disposed on the rear of skate 500. Braking system 504 includes housing 122 which is rotatably mounted on cuff 104 at pivot point 513. Housing 122 includes a brake pad 124 disposed therein. Roller arm 126 is rotatably mounted on chassis 502 about rotary axis 128.

Braking system 504 further includes a linkage member 506 which is pivotally mounted at a first end 508 on chassis 502 about rotary axis 128. Linkage member 506 is pivotally mounted at a second end 510 on housing 122 about a rotary axis 512. Thus, first end 508 of linkage member 506 and roller arm 126 rotate about the same rotary axis 128 at the same pivot point. This configuration allows housing 122 and roller arm 126 to follow the same arc during rotation relative to each other so that brake pad 124 is accurately positioned for ful engagement with bearing assembly 406 during braking. Thus, rotation of housing 122 is isolated from the rotation of cuff 104.

In operation, a skater moves skate 500, having a brake mounted thereon, forward of his remaining skate so that the skater's calf causes cuff 104 of skate 500 to rotate rearwardly with respect to boot 102. Rearward rotation of cuff 104 causes housing 122 and brake pad 124 to move downwardly. As brake pad 124 moves downwardly, it engages bearing assembly 406, thereby forcing roller arm 126 to rotate toward rear wheel 110 of skate 500. Rotation of roller arm 126 coincides with rotation of linkage member 506. Rotation of linkage member 506 causes housing 122 to pivot about rotary axis 512. Rotation of housing 122 causes brake pad 124 to be accurately positioned to engage bearing assembly 406 of roller arm 126. Bearing assembly 406 then engages rear wheel 110, thereby slowing skate 100.

Due to uneven ground conditions and a skater's uneven skating motion, it is possible that not all wheels would remain on the ground at all times during the braking process. The reduced contact between braked rear wheel 110 and the ground would reduce braking performance and increase wheel wear due to skidding. In the present invention, braking performance can be improved by biasing the rear wheel toward the ground when the brake is underload, i.e., activated. Constant engagement between the braked wheel and the ground can be achieved, as described below, which increases braking ability and reduces uneven wheel wear in the braked rear wheel.

Figure 6:
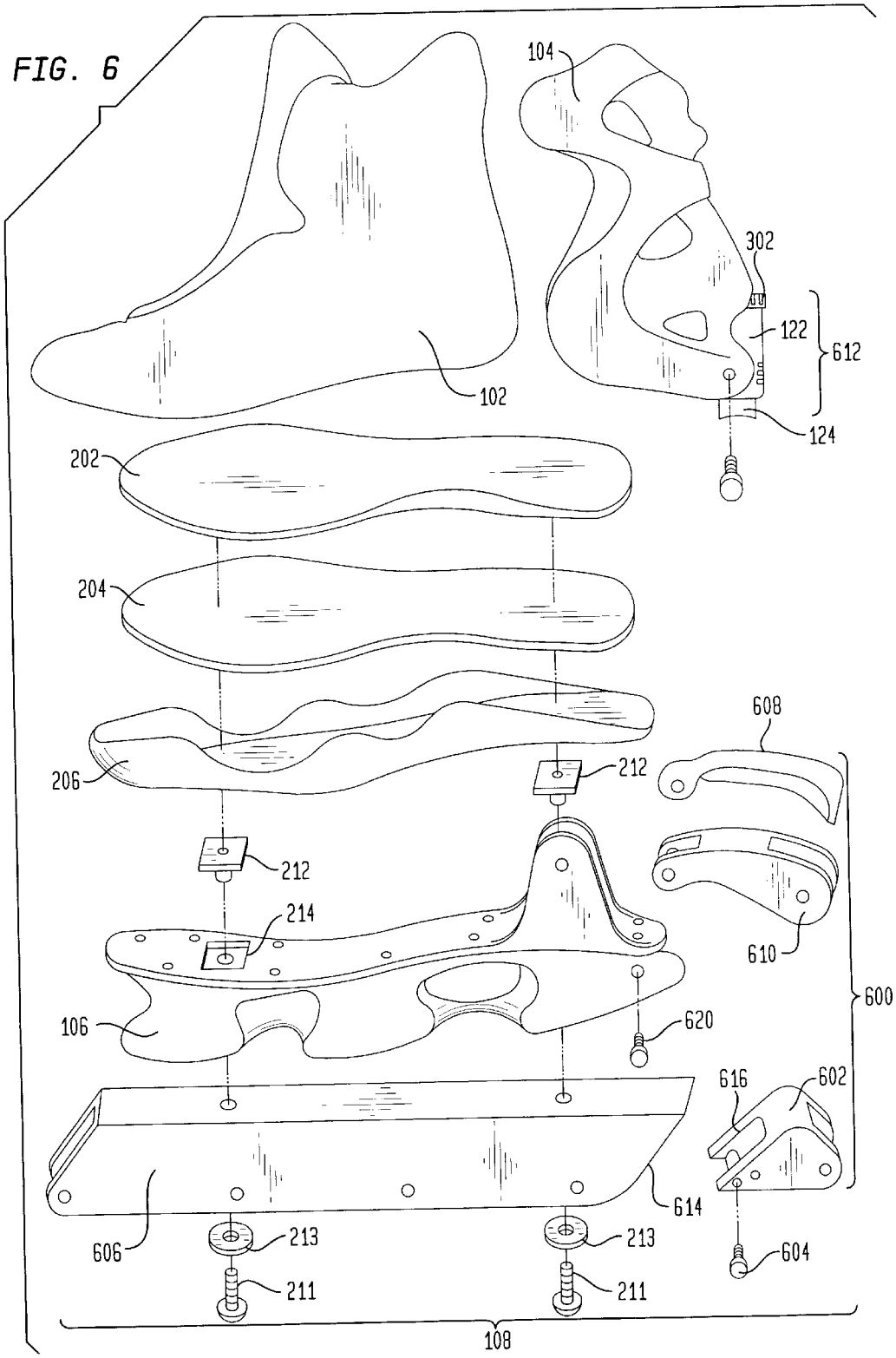
FIG. 6 shows a exploded, perspective view of a skate including a third embodiment for a braking system of the present invention.

FIGS. 6–10 show a third embodiment of a braking system 600 of the present invention. In particular, FIG. 6 shows an assembly drawing of a skate having a braking system 600 incorporated therein as well as the remainder of the skate as described above with respect to FIG. 2. Braking system 600 incorporates a two-part frame member 108 having a biased frame portion 602 pivotally mounted by a pivot pin 604 to a main frame portion 606. Main frame portion 606 has a first proximate end 614 formed diagonally thereon. In addition, biased frame portion 602 has a second proximate end 616 formed at a cooperating diagonal with first proximate end 614. The range of upward rotation of biased frame portion 602 about pivot pin 604 is limited by the juxtaposition of these two ends 614 and 616. It would be apparent to one skilled in the relevant art that two-part frame member 108 could also be incorporated into the embodiments discussed above with respect to FIGS. 1–5 to incorporate a biased rear wheel therein to enhance the braking action and reduce wheel wear.

Figure 8:
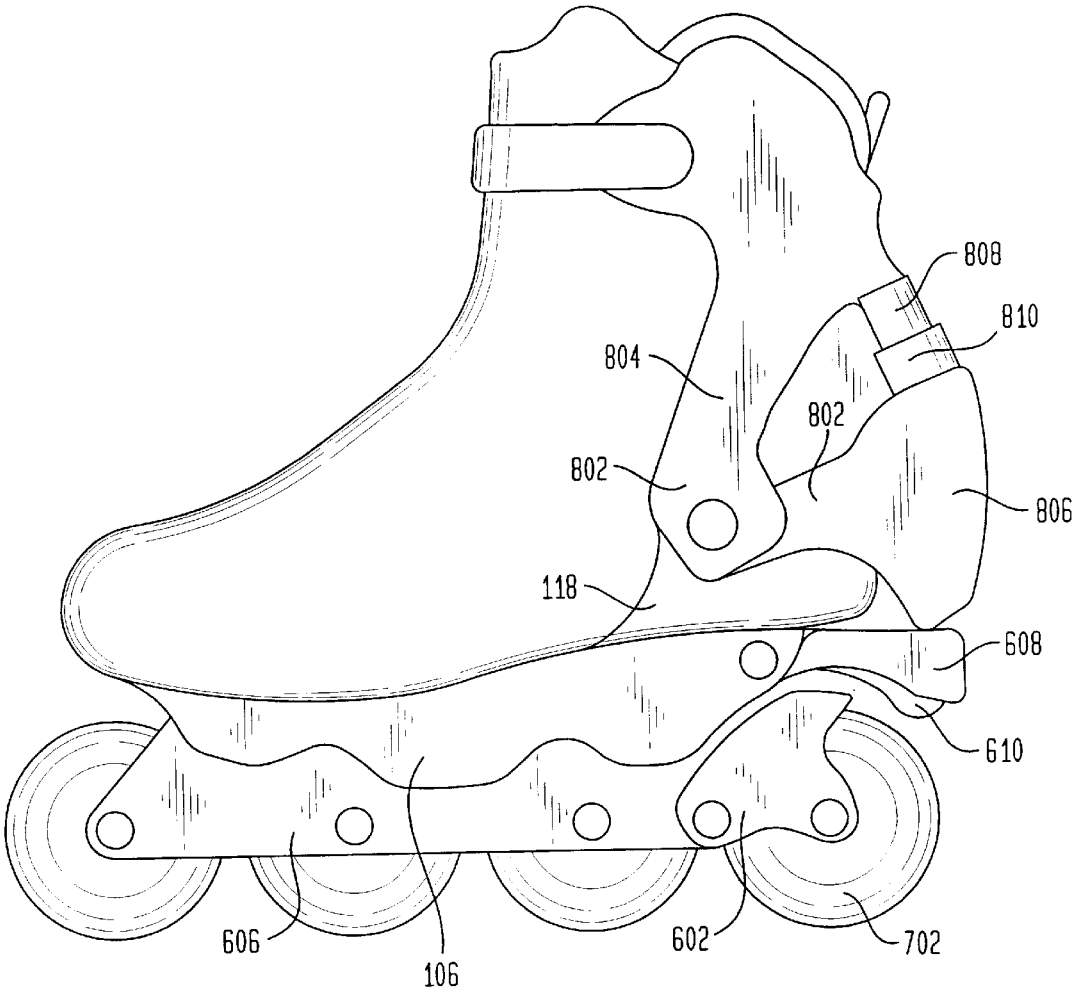
FIG. 8 shows a side view of a skate having a braking system as shown in FIG. 6 and an alternate cuff and adjustment linkage embodiment.
Figure 9:
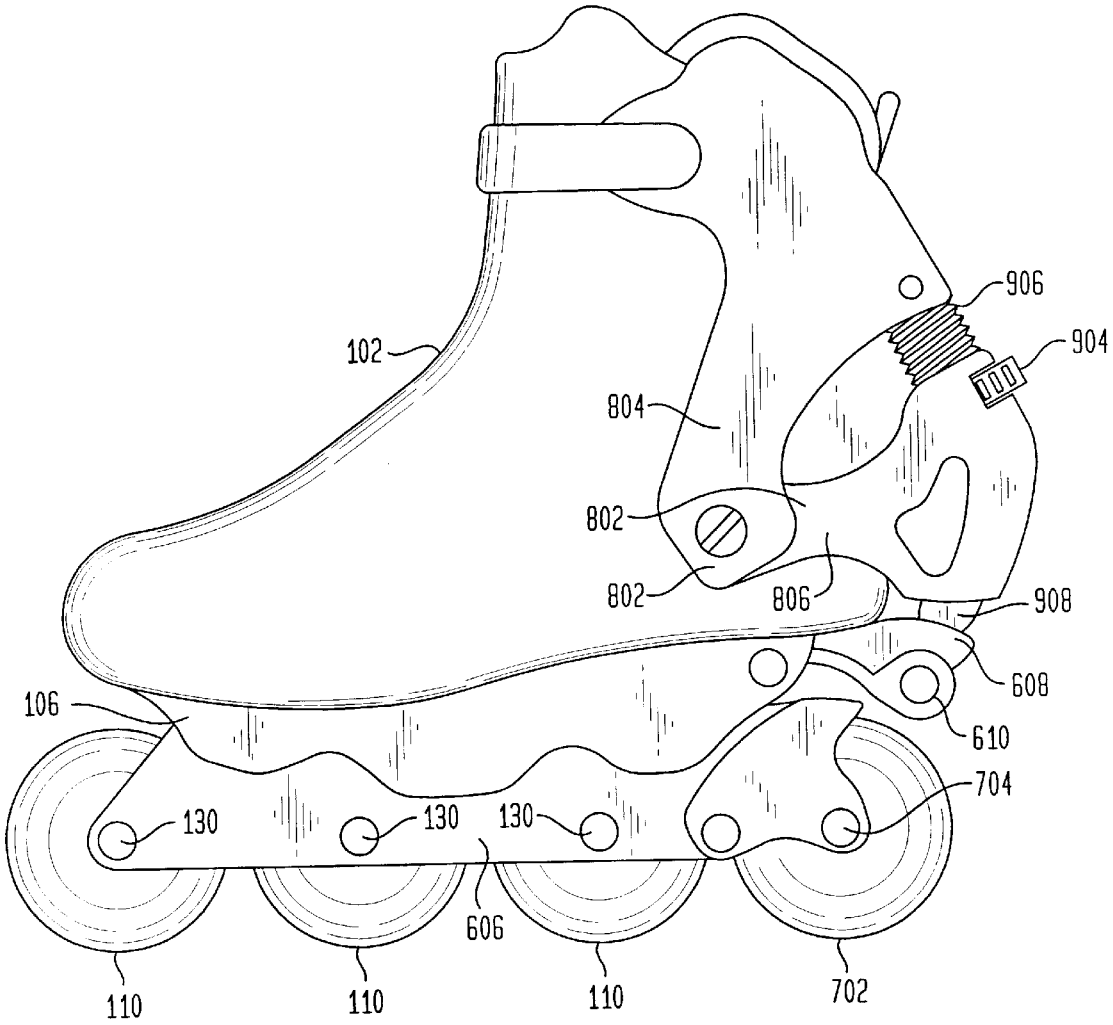
FIG. 9 shows a side view of a skate having a braking system as shown in FIG. 6 and a second cuff and adjustment linkage embodiment.
Figure 10:
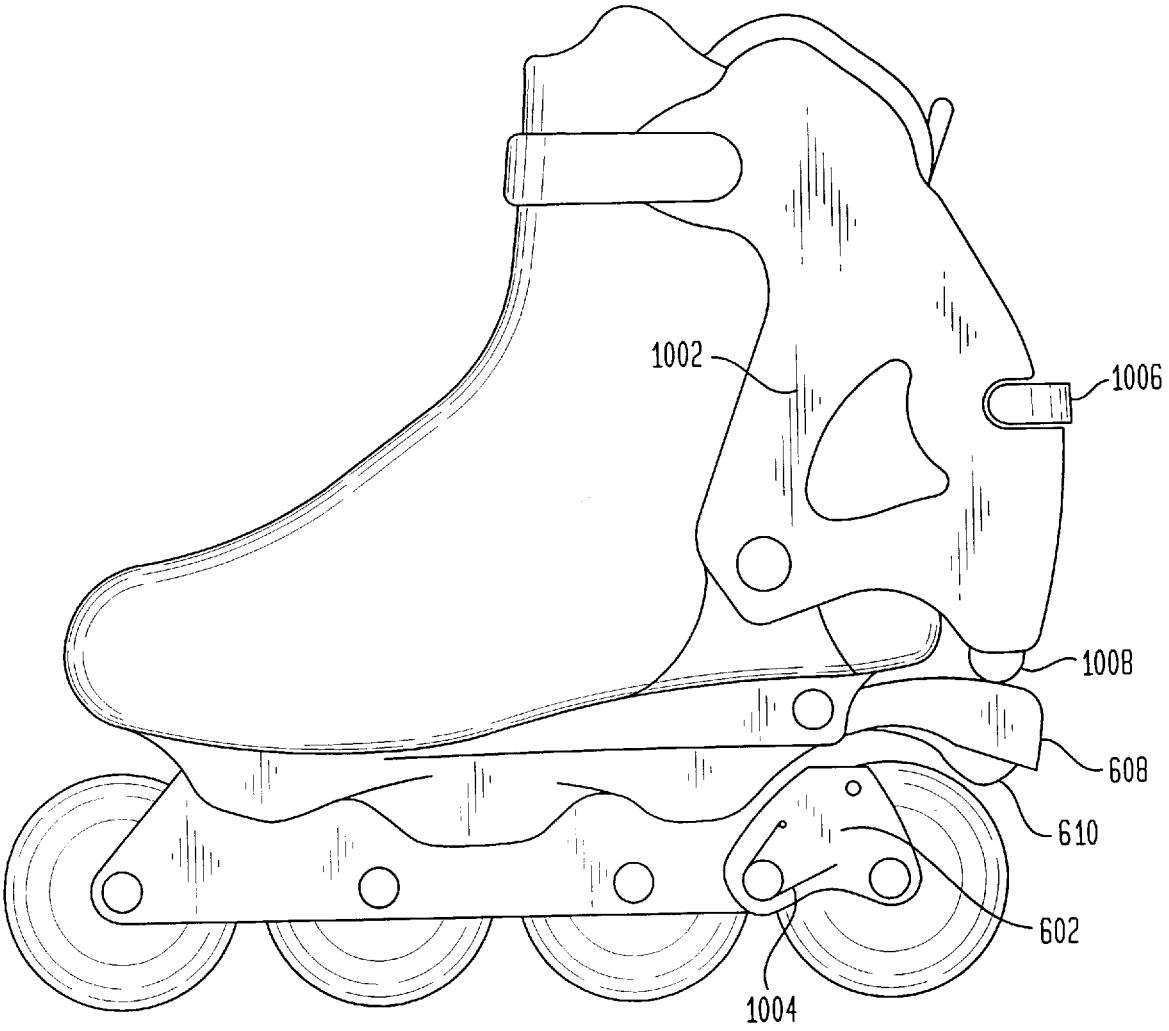
FIG. 10 shows a side view of a skate having a braking system as shown in FIG. 6, a third cuff and adjustment linkage embodiment, and a spring configuration for biasing a rear wheel.

Braking system 600 further includes a brake pad arm 608 and a roller arm 610 pivotally mounted about a common axis to transition mount 106 by a pivot pin 620. Braking system 600 also includes an adjustment linkage 612 which, in FIG. 6, consists of adjuster dial 302, bracket 304 (not shown in FIG. 6), housing 122, and brake pad 124, as described above with respect to braking assembly 300 and shown in FIG. 3. It would be apparent to one skilled in the relevant art that a variety of other adjustment linkages could be used for actuation of braking system 600. Examples of alternate cuff and adjustment linkages are shown in FIGS. 8–10 and will be discussed in further detail below.

Figure 7:
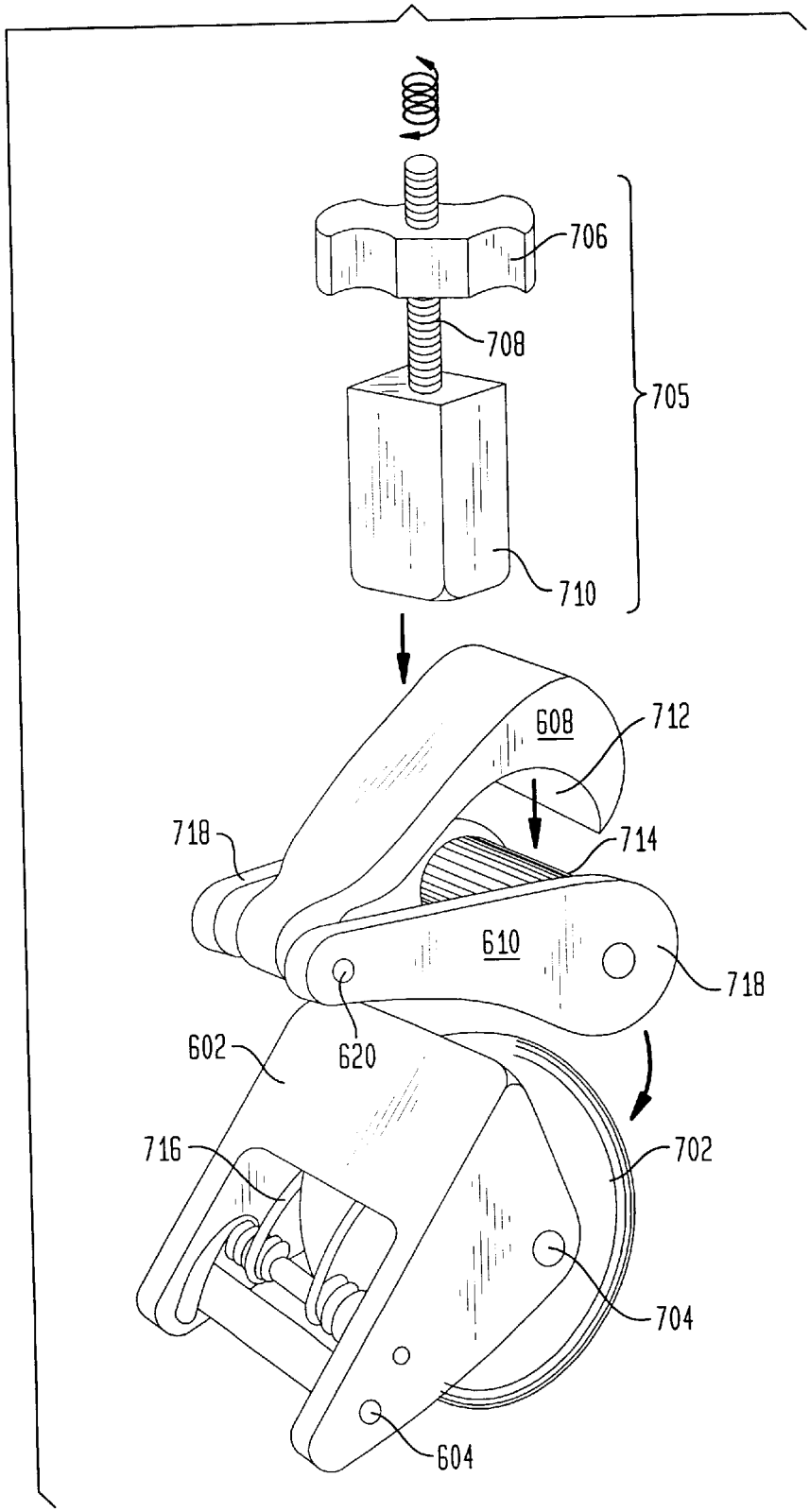
FIG. 7 shows an exploded perspective view of the braking system shown in FIG. 6.

FIG. 7, shows an exploded, detailed view of braking system 600. As shown in FIG. 7, a biased rear wheel 702 is attached to biased frame portion 602 via an axle 704. A spring 716 retains biased frame portion 602 in an upwardly biased position when the brake is not in use.

FIG. 7 shows brake pad arm 608 and roller arm 610 in further detail. In particular, brake pad arm 608 has a brake pad 712 mounted on a lower side thereof. Roller arm 610 has a roller 714 rotatingly disposed between arm portions 718. Roller 714 is constructed in a similar fashion to roller 406 described above.

In FIG. 7, an alternate adjustment linkage 705 includes an adjuster dial 706, an adjustment mechanism 708, and a distal end 710. Distal end 710 can be rotatingly adjusted up or down using adjuster dial 706 to account for wear of brake pad 712 and biased rear wheel 702. Brake pad arm 608 and roller arm 610 are spring biased so that when not in use these members do not contact biased rear wheel 702.

Using the embodiment shown in FIG. 7 as an example, the braking system of the present invention will be described in use. During braking, cuff 104 is rotated rearwardly by the wearer thereby moving adjustment linkage 705 in a downward direction. Such movement causes distal end 710 to engage brake pad arm 608, as represented by an arrow in FIG. 7. In turn, brake pad 712, disposed in brake pad arm 608, comes into contact with roller 714. This contact causes roller arm 610 to rotate about pivot pin 620 so that roller 714 comes into contact with biased rear wheel 702. The combination of frictional engagement of these members causes a slowing of the rotation of biased rear wheel 702.

While the braking force is applied, biased frame portion 602 is rotated downward about pivot pin 604 as a result of the downward force on rear wheel 702, thereby overcoming the biasing force of spring 716 and maintaining contact between biased rear wheel 702 and the ground. By maintaining constant contact with the ground, skidding of the wheel is eliminated, thereby reducing wheel wear. To further reduce wheel wear, the biased rear wheel 702 may be made of a composite rubber material.

FIGS. 8–10 show alternate embodiments of cuff assemblies and adjustment linkages of braking system 600. FIG. 8 shows a skate having a cuff assembly 802 that is formed in two portions. An upper cuff portion 804 and a lower cuff portion 806 of cuff assembly 802 are pivotally mounted to flanges 118 of transition mount 106, as discussed above with respect to the first embodiment. In this embodiment, lower portion 806 of cuff assembly 802 directly contacts brake pad arm 608 to activate braking system 600. A threaded adjustment mechanism 808 moves in and out of lower portion 806 when an adjuster dial 810 is rotated. The distance between upper cuff portion 804 and lower portion 806 is thereby manipulated to achieve the skater's desired sensitivity for brake actuation.

FIG. 9 shows an alternate cuff assembly and adjustment linkage to be used to actuate braking system 600. As in the previous embodiment, cuff assembly 802 is formed of upper cuff portion 804 and lower portion 806. However, in this embodiment a spring dampened plunger 908 contacts brake pad arm 608 to activate braking system 600. The sensitivity of the brake actuation can be adjusted by rotating an adjuster dial 904 to adjust the cant of cuff assembly 802 by raising and lowering spring dampened plunger 908. A spring 906 positioned between upper cuff portion 804 and lower cuff portion 806 is compressed during the rearward movement of cuff assembly 802 while braking to allow the skater to better feel the braking action. It would be apparent to one skilled in the relevant art that spring 906 could be designed to have a high resistance, so that the braking action feels "hard" to the user, or could be designed to have a low resistance, so that the braking action feels "soft" to the user, as desired.

FIG. 10 shows a third cuff assembly and adjustment linkage to be used to actuate braking system 600. In this embodiment, a one-piece cuff assembly 1002 is shown. The height of cuff assembly 1002 relative to brake pad arm 608, and thereby the amount of rearward rotation of cuff assembly 1002 needed to actuate the brake, is adjusted by rotation of an adjuster dial 1006. This rotation in turn raises or lowers a contact pad 1008 on the lower end of cuff 1002 thereby achieving the skater's desired brake sensitivity. Contact pad 1008 comes in contact with brake pad arm 608 when cuff 1002 is rotated rearwardly. This movement causes rotation of brake pad arm 608 and roller arm 610 about pivot pin 620, and the brake is actuated as described previously. Further, in the embodiment shown in FIG. 10, biased frame portion 602 includes an alternate spring assembly 1004 attached to the exterior thereof.

While the invention has been particularly shown and described with reference to preferred embodiments thereof, it will be understood by those skilled in the art that various changes in form and details may be made therein without departing from the spirit and scope of the invention. In particular, while the invention has been shown and described as applied to in-line skates, it would be apparent to one skilled in the relevant art that the present invention could also be adapted for use as braking systems for various other human-powered vehicles, such as roller skis or skateboards.

What is claimed is:

1. An in-line skate, comprising:

a boot;

a chassis having an upper surface and a lower surface, wherein said boot is disposed about said upper surface of said chassis;

a plurality of wheels disposed on said lower surface of said chassis;

a cuff rotatably disposed on said chassis about a first pivot axis; and a braking system, including, a housing attached to a rear portion of said cuff, a brake pad disposed in said housing, and a roller arm rotatably mounted on said chassis about a second pivot axis such that said roller arm, in a resting position, is disposed proximate at least one of said plurality of wheels, said roller arm having a bearing assembly disposed therein, wherein rotation of said cuff causes said brake pad to engage said bearing assembly, thereby causing said bearing assembly to engage said at least one of said plurality of wheels.

2. The in-line skate of claim 1, wherein said chassis comprises a frame member for housing said plurality of wheels and a transition mount disposed between said frame member and said boot.

3. The in-line skate of claim 2, wherein said transition mount includes flanges, said cuff being pivotally mounted on said flanges of said transition mount.

4. The in-line skate of claim 1, wherein said braking system further comprises a bracket, said brake pad being disposed in said bracket, and wherein said bracket is disposed within said housing.

5. The in-line skate of claim 1, wherein said braking system further comprises an adjuster knob, rotatably disposed in said brake pad, for adjusting the vertical position of said brake pad within said housing.

6. The in-line skate of claim 1, wherein said roller arm is spring-mounted on said chassis, so that said roller arm returns to its uppermost position after braking occurs.

7. The in-line skate of claim 1, wherein said brake pad has a lower end, said lower end being concave to mate with said bearing assembly.

8. A braking system for an in-line skate, the in-line skate having a cuff and a plurality of wheels, said braking system comprising:

a housing fixedly secured to a rear portion of the skate;

a brake pad disposed in said housing having a threaded insert disposed therein;

an adjustment device having a threaded end disposed in said threaded insert of said brake pad, wherein rotation of said adjustment device adjusts the location of said brake pad relative to said housing; and a roller arm rotatably mounted on said skate such that said roller arm, in a resting position, is disposed proximate at least one of said plurality of wheels, wherein rotation of said cuff causes said brake pad to engage said roller arm, thereby causing said roller arm to engage said at least one of said plurality of wheels.

9. The braking system of claim 8, further comprising a bracket, said brake pad being disposed in said bracket, wherein said bracket is disposed within said housing.

10. The braking system of claim 8, wherein said roller arm is spring-mounted on the skate, so that said roller arm returns to its uppermost position after braking occurs.

11. The braking system of claim 8, wherein said roller arm comprises a bearing assembly, said bearing assembly engaging said at least one of said plurality of wheels upon rotation of said cuff.

12. The braking system of claim 11, wherein said brake pad has a lower end, said lower end being concave to mate with said bearing assembly.

13. An in-line skate, comprising:

a boot;

a chassis having an upper surface and a lower surface, wherein said boot is disposed about said upper surface of said chassis;

a plurality of wheels disposed about said lower surface of said chassis;

a cuff rotatably disposed on said chassis about a first pivot axis; and a braking system, including, a housing pivotally attached at an upper end to a rear portion of said cuff, a brake pad disposed in said housing, a roller arm rotatably mounted on said chassis about a second pivot axis such that said roller arm, in a resting position, is disposed proximate at least one of said plurality of wheels, said roller arm having a bearing assembly disposed therein, and a linkage member having a first end and a second end, said first end of said linkage member being pivotally attached to said chassis about said second pivot axis, and said second end of said linkage member being pivotally attached to said housing, wherein rotation of said cuff causes said brake pad to engage said bearing assembly, thereby causing said roller arm and said linkage member to pivot about said second pivot axis and said bearing assembly to engage said at least one of said plurality of wheels.

14. The in-line skate of claim 13, wherein said braking system further comprises a bracket, said brake pad being disposed in said bracket, and wherein said bracket is disposed within said housing.

15. The in-line skate of claim 13, wherein said braking system further comprises an adjuster knob, rotatably disposed in said brake pad, for adjusting the vertical position of said brake pad within said housing.

16. The in-line skate of claim 13, wherein said roller arm is spring-mounted on said chassis, so that it returns to its uppermost position after braking occurs.

17. An in-line skate, comprising:

a boot;

a two-part frame member disposed below said boot, having a main frame portion and a biased frame portion pivotally mounted to said main frame portion;

a plurality of wheels disposed beneath said main frame portion;

a wheel axially disposed within said biased frame portion;

a cuff adjacent said boot and rotatably disposed about a first pivot axis; and a braking system disposed above said biased frame portion, said braking system having a brake pad arm pivotally mounted about a second pivot axis, a brake pad contained within said brake pad arm, a roller arm pivotally mounted about a third pivot axis, and a roller rotatingly disposed within said roller arm, wherein rearward rotation of said cuff causes said brake pad to engage said roller arm, thereby causing said roller to engage said wheel of said biased frame portion, thereby forcing said biased frame portion downwardly so that said wheel of said biased frame portion engages a skating surface.

18. The in-line skate of claim 17, wherein said braking system further comprises:

an adjustment linkage disposed on a rear portion of said cuff, said adjustment linkage including means to adjust the amount of rearward rotation of said cuff necessary to actuate said braking system.

19. The in-line skate of claim 18, wherein said adjustment linkage comprises:

an adjuster dial mounted on a rear portion of said cuff; and a distal end extending from a lower surface of said cuff, wherein rotation of said adjuster dial causes said distal end to move up or down relative to said lower surface of said cuff.

20. The in-line skate of claim 18, wherein said cuff comprises a first portion and a second portion, and wherein said adjustment linkage comprises a threaded adjustment mechanism disposed on said first portion of said cuff and an adjuster dial disposed on said second portion of said cuff and engaged with said threaded adjustment mechanism, such that rotation of said adjuster dial causes said threaded adjustment mechanism to move into or out of said second portion of said cuff to adjust the distance between said first and second portions of said cuff.

21. The in-line skate of claim 17, wherein said cuff comprises a first portion and a second portion, and wherein-a spring is disposed between said first and second portions of said cuff.

22. The in-line skate of claim 17, further comprising:

a transition mount disposed on said two-part frame member, wherein said boot is disposed on said transition mount.

23. The in-line skate of claim 17, wherein said main frame portion has a first proximate end formed at a diagonal, and said biased frame portion has a second proximate end disposed adjacent to said first proximate end of said main frame portion, said second proximate end of said biased frame portion is formed at a cooperating diagonal to said first proximate end, so that the juxtaposition of the first and second proximate ends limits the range of rotation of said biased frame portion relative to said main frame portion.

* * * * *